US010479110B2

(12) United States Patent
Rasmussen et al.

(10) Patent No.: US 10,479,110 B2
(45) Date of Patent: Nov. 19, 2019

(54) PARTIALLY DRIED INKJET MEDIA FUSERS

(71) Applicant: Hewlett-Packard Development Company, L.P., Houston, TX (US)

(72) Inventors: Steve O Rasmussen, Vancouver, WA (US); Mark H MacKenzie, Corvallis, OR (US); Bradley B Branham, Vancouver, WA (US); Jeffrey G Bingham, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/763,509

(22) PCT Filed: Jan. 15, 2016

(86) PCT No.: PCT/US2016/013735

§ 371 (c)(1),
(2) Date: Mar. 27, 2018

(87) PCT Pub. No.: WO2017/123258

PCT Pub. Date: Jul. 20, 2017

(65) Prior Publication Data

US 2018/0272753 A1 Sep. 27, 2018

(51) Int. Cl.

| | |
|---|---|
| ***B41J 11/00*** | (2006.01) |
| ***B65H 23/34*** | (2006.01) |
| ***B41M 7/00*** | (2006.01) |
| ***G03G 15/00*** | (2006.01) |

(Continued)

(52) U.S. Cl.
CPC ..... *B41J 11/002* (2013.01); *B41J 11/0005* (2013.01); *B41J 11/0015* (2013.01);
(Continued)

(58) Field of Classification Search
CPC ... B41J 11/002; B41J 11/0005; B41M 5/0011; B41M 7/00; B65H 23/34;
(Continued)

(56) References Cited

U.S. PATENT DOCUMENTS 4,300,891 A 11/1981 Bemiss
5,450,182 A * 9/1995 Wayman ..... G03G 15/2064 399/328

(Continued)

FOREIGN PATENT DOCUMENTS

EP 1195644 A2 4/2002
JP 2002-147952 5/2002

(Continued)

OTHER PUBLICATIONS

Ahrens et al. Investigation of Paper Dryer Picking, Web Transfer and Quality issues Using a New Web Adhesion and Drying Simulator. BR Jml of Chem Engineering~2005~9 pages.

*Primary Examiner* — Anh T Vo
(74) *Attorney, Agent, or Firm* — Brooks Cameron & Huebsch PLLC

(57) ABSTRACT

In one example, a system for partially dried inkjet media fusers include a plurality of fusers aligned to receive partially dried inkjet media from a printing device, wherein the plurality of fusers each comprise a top roller and a bottom roller to apply pressure to the received partially dried inkjet media, and a finisher to receive the partially dried inkjet media from the plurality of fusers.

17 Claims, 3 Drawing Sheets

(51) Int. Cl.
*B41M 5/00* (2006.01)
*D21H 25/04* (2006.01)

(52) U.S. Cl.
CPC ..... *B41M 5/0011* (2013.01); *B65H 23/34* (2013.01); *D21H 25/04* (2013.01); *G03G 15/6576* (2013.01); *B41M 7/00* (2013.01); *B65H 2301/51256* (2013.01)

(58) Field of Classification Search
CPC ..... B65H 2301/51256; G03G 15/6576; G03G 2215/00662; D21H 25/04
See application file for complete search history.

(56) References Cited

U.S. PATENT DOCUMENTS 5,515,152 A 5/1996 Kuo
6,243,559 B1 * 6/2001 Kurotaka ..... G03G 15/2064 219/216
7,043,185 B2 * 5/2006 Yoshikawa ..... G03G 15/2064 399/329
2005/0190247 A1 9/2005 Unter
2006/0067757 A1 * 3/2006 Anderson ..... G03G 15/2014 399/341
2007/0120933 A1 * 5/2007 Mueller ..... G03G 15/0194 347/103
2008/0252000 A1 10/2008 Dochi
2011/0001785 A1 1/2011 Tsuzawa et al.
2013/0076844 A1 3/2013 Tombs et al.
2015/0367340 A1 12/2015 Beachner et al.

FOREIGN PATENT DOCUMENTS

JP 2002-213434 A 7/2002
JP 2011-225315 11/2011
JP 2013-028121 2/2013
JP 2015-128876 7/2015

* cited by examiner

PARTIALLY DRIED INKJET MEDIA FUSERS

BACKGROUND

Inkjet printers can deposit quantities of printing fluid onto a printable media (e.g., paper, plastic, etc.). In some examples, inkjet printers can create a curl and/or cockle in the printed media when the printing fluid droplets deposited by the inkjet printer are not completely dry. In some examples, a number of physical properties of the printable media can be changed when the printing fluid droplets deposited by the inkjet printer are not completely dry. For example, the stiffness of the printable media can be changed when the printing fluid droplets deposited by the inkjet printer are not completely dry. The curl, cockle, and/or other physical properties that change due to the printing fluid droplets can make finishing processes difficult.

DETAILED DESCRIPTION

Figure 1:
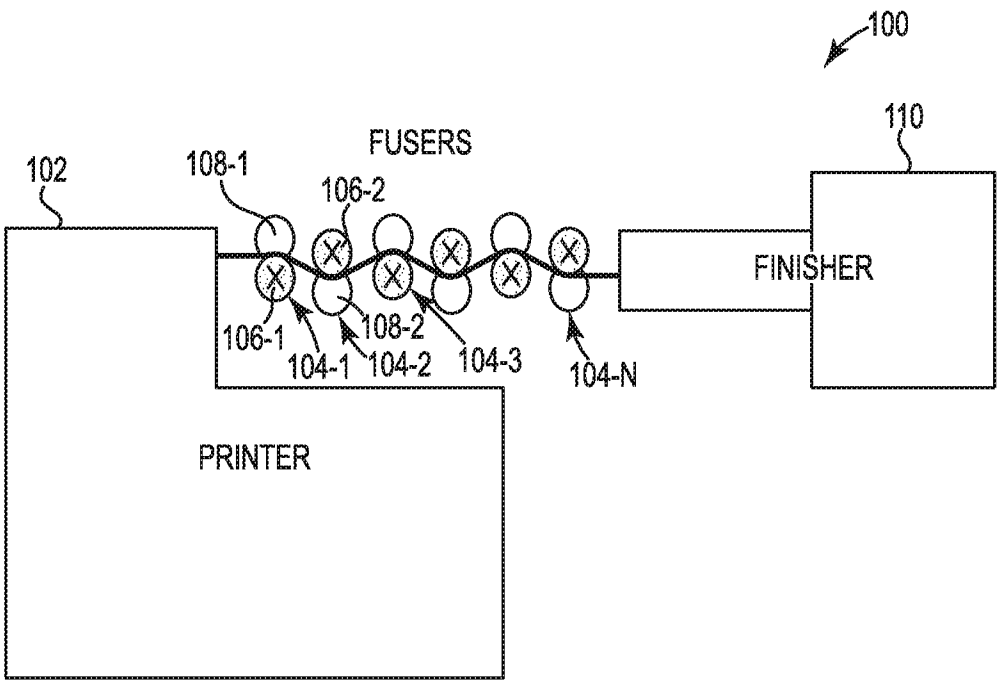
FIG. 1 illustrates an example system for partially dried inkjet media fusers consistent with the present disclosure.

A number of systems and devices for partially dried inkjet media fusers are described herein. In some examples, a system for partially dried inkjet media fusers can include a plurality of fusers aligned to receive partially dried inkjet media from a printing device, wherein the plurality of fusers each comprise a top roller and a bottom roller to apply pressure and heat to the received partially dried inkjet media, and a finisher to receive the partially dried inkjet media from the plurality of fusers. As used herein, partially dried inkjet media can include media with applied printing fluid from an inkjet type printing device that is not completely dried on the media.

The partially dried inkjet media can provide difficulties when stacking, aligning, and/or finishing. For example, the partially dried inkjet media can have distorted properties such as a curl, a cockle, a reduction in stiffness, increased surface roughness, exposed fibers, misaligned fibers, and/or increased sheet to sheet friction of the media. In some examples, these distorted properties can be caused by printing fluid deposited on the media and the media absorbing the printing fluid. For example, the printing fluid can be in a liquid state that can be absorbed by a media such as paper. In this example, the liquid state of the printing fluid can cause the distorted properties of the media in a similar way that other liquids may distort the properties of the media.

In some examples, the plurality of fusers can be coupled between a printing device (e.g., inkjet printer, etc.) and a finishing device (e.g., finisher, etc.). For example, the plurality of fusers can receive partially dried inkjet media from a printer and the plurality of fusers can provide the partially dried inkjet media to a finisher for performing a finishing process (e.g., stacking, collating, stapling, hole punching, binding, etc.). In some examples, the plurality of fusers can each include a number of rollers. For example, a fuser from the plurality of fusers can include a top roller to interact with a first side of partially dried inkjet media and a second roller to interact with a second side of partially dried inkjet media.

The plurality of fusers can be utilized to apply a pressure to the partially dried inkjet media to restore or partially restore the distorted properties caused by the printing fluid absorbed by the media. For example, the plurality of fusers can be utilized to enhance drying of the printing fluid with pressure, heat, by means of a contact zone, and/or a wrap angle. In some examples, the plurality of fusers can utilize alternating wrap angles from a first fuser to a second fuser to restore or partially restore the distorted properties of the partially dried inkjet media.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense.

FIG. 1 illustrates an example system 100 for partially dried inkjet media fusers consistent with the present disclosure. The system 100 can be utilized to restore or partially restore a number of distorted properties of partially dried inkjet media to perform a finishing process. As described herein, the number of distorted properties of partially dried inkjet media can cause problems when attempting to perform a finishing process.

The system 100 can include a printer 102. In some examples, the printer 102 can be an inkjet printer that can deposit a printing fluid (e.g., ink, etc.) on a print media. As described herein, the printing fluid may not be completely dry when the print media is provided to a number of fusers 104-1, 104-2, 104-3, 104-N. For example, the printer 102 can generate partially dried inkjet media and provide the partially dried inkjet media to the number of fusers 104-1, 104-2, 104-3, 104-N. In some examples, the number of fusers 104-1, 104-2, 104-3, 104-N can be coupled to the printer 102 such that partially dried inkjet media is directly provided to the number of fusers 104-1, 104-2, 104-3, 104-N by the printer 102.

In some examples, the number of fusers 104-1, 104-2, 104-3, 104-N can include a number of rollers (e.g., heated rollers 106-1, 106-2, non-heated rollers 108-1, 108-2, etc.). In some examples, the number of rollers can be positioned to apply pressure to partially dried inkjet media received from the printer 102. In some examples, the number of fusers 104-1, 104-2, 104-3, 104-N can each include a number of heated rollers 106-1, 106-2 paired with a corresponding number of non-heated rollers 108-1, 108-2. In some examples, the heated rollers 106-1, 106-2 can include a "hot roller" with an internal heat source to heat the surface of the roller. In other examples, the heated rollers 106-1, 106-2 can be assemblies with a heated contact zone. For example, the heated rollers 106-1, 106-2 can each include an area of the surface of the assembly that produces heat within the area. The number of fusers 104-1, 104-2, 104-3, 104-N can utilize the pressure and heat applied to the partially dried inkjet media to restore a number of the distorted properties.

In some examples, the number of fusers 104-1, 104-2, 104-3, 104-N can utilize a number of active rollers and a number of passive rollers to move the partially dried inkjet media from the printer 102 to the finisher 110. As used herein, an active roller can include a roller that mechanically moves in a particular direction. For example, the active roller can coupled to a motor that actively moves the roller. In some examples, the number of heated rollers 106-1, 106-2 can be active rollers. In some examples, the number of heated rollers 106-1, 106-2 can be active rollers to provide greater contact with the partially dried inkjet media. Conversely, the number of non-heated rollers 108-1, 108-2 can be active rollers.

As used herein, a passive roller can include a roller that does not mechanically move independent of other rollers (e.g., active rollers, etc.). For example, the number of passive rollers can be coupled to bearings that allow the number of passive rollers to move, but are not coupled to a mechanical device to physically move the number of passive rollers. In some examples, the number of non-heated rollers 108-1, 108-2 can be passive rollers. For example, the number of non-heated rollers 108-1, 108-2 can be passive rollers that are coupled to a bearing system such that the non-heated rollers 108-1, 108-2 are moved by the heated rollers 106-1, 106-2.

In some examples, the number of fusers 104-1, 104-2, 104-3, 104-N can be aligned in a substantially linear fashion such that a wrap angle of the partially dried inkjet media passing through the number of fusers 104-1, 104-2, 104-3, 104-N is between 0 degrees and 20 degrees. As described further herein, the wrap angle of the partially dried inkjet media can be altered based on a number of factors (e.g., type of printer, quantity of printing fluid applied, printing fluid application, etc.). In some examples, the wrap angle of the partially dried inkjet media generated by the number of fusers 104-1, 104-2, 104-3, 104-N can apply a tension on the partially dried inkjet media. In some examples, the tension applied on the partially dried inkjet media can restore a number of the distorted properties of the partially dried inkjet media.

In some examples, the number of fusers 104-1, 104-2, 104-3, 104-N can be within an enclosure (not shown). In these examples, the enclosure can include an air circulation device. The air circulation device can be utilized to remove moist air from the enclosure. Removing the moist air from the enclosure can increase drying of the printing fluid deposited on the print media. In some examples, the air circulation device can also be utilized to provide heated air to the partially dried inkjet media.

Figure 2:
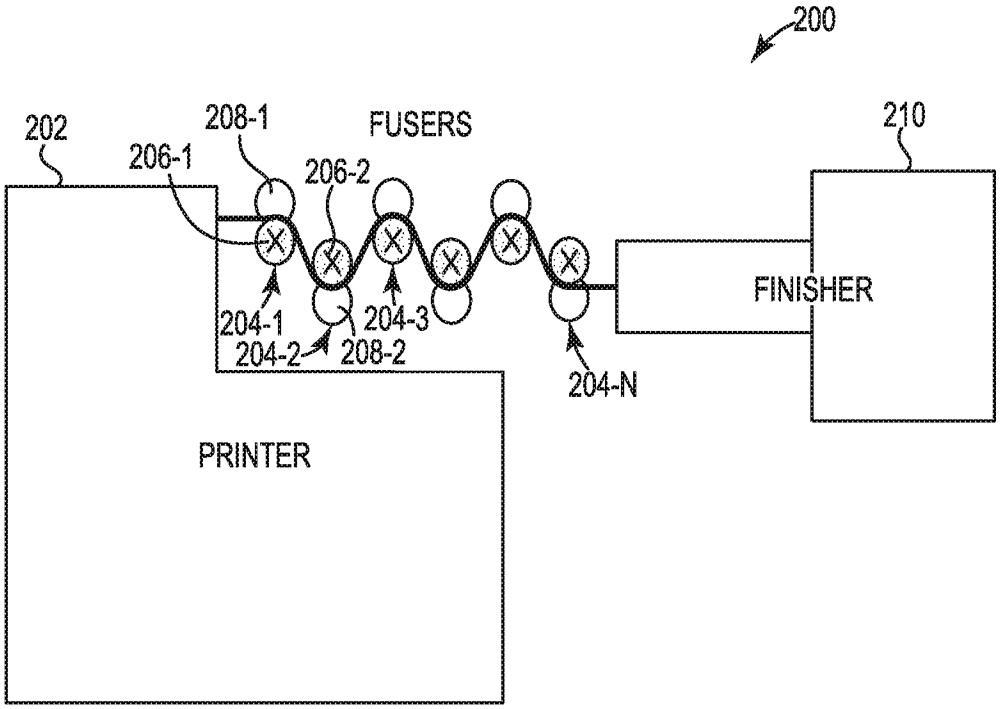
FIG. 2 illustrates an example system for partially dried inkjet media fusers consistent with the present disclosure.

FIG. 2 illustrates an example system 200 for partially dried inkjet media fusers consistent with the present disclosure. In some examples, the system 200 can include the same or similar elements as the system 100 as referenced in FIG. 1. For example, the system 200 can include a printer 202 and a finisher 210 each coupled to a number of fusers 204-1, 204-2, 204-3, 204-N. As described herein, the printer 202 can include an inkjet printer that can generate partially dried inkjet media. As described herein, the partially dried inkjet media can include a number of distorted properties that can be caused by printing fluid deposited on the inkjet media.

In some examples, each of the number of fusers 204-1, 204-2, 204-3, 204-N can include a number of heated rollers 206-1, 206-2 and a number of non-heated rollers 208-1, 208-2. In some examples, each of the number of fusers 204-1, 204-2, 204-3, 204-N can include one heated roller 206-1, 206-2 and one non-heated roller 208-1, 208-2. For example, the fuser 204-1 can include a bottom roller that is a heated roller 206-1 and a top roller that is a non-heated roller 208-1. In this example, the fuser 204-1 can be the first fuser that receives the partially dried inkjet media. In this example, the heated roller 206-1, can be positioned such that the most recently printed side or surface of the partially dried inkjet media is in contact with the heated roller 206-1.

In some examples, the number of fusers 204-1, 204-2, 204-3, 204-N can be aligned in a non-linear fashion such that a wrap angle of the partially dried inkjet media passing through the number of fusers 204-1, 204-2, 204-3, 204-N is between 20 degrees and 180 degrees. The wrap angle of the partially dried inkjet media can be altered based on a number of factors (e.g., type of printer, quantity of printing fluid applied, printing fluid application, etc.). For example, a greater wrap angle can generate a greater quantity of contact time (e.g., tension time, etc.) for the partially dried inkjet media. As used herein, the contact time can include a quantity of time that the partially dried inkjet media is in contact with the number of fusers 204-1, 204-2, 204-3, 204-N.

In some examples, the partially dried inkjet media can have fibers of the media that are exposed or misaligned from the printing fluid. The exposed or misaligned fibers can cause the partially dried inkjet media to be relatively less stiff compared to the inkjet media prior to depositing the printing fluid. The exposed or misaligned fibers can also distort a number of other properties as described herein. In some examples, the quantity of tension time or tension force, the reversing bends and the repeated application of pressure applied to the partially dried inkjet media while drying from the exposure to the heated rollers 206-1, 206-2, 206-3 can correspond to a greater fiber re-alignment and/or greater reinsertion of exposed fibers. For example, the tension, reversing bends, repeated pressure and/or heat applied to the partially dried inkjet media can restore a number of the distorted properties of the partially dried inkjet media that may not be restored by the applied pressure or heat applied by the number of fusers 204-1, 204-2, 204-3, 204-N.

As described herein, the number of fusers 204-1, 204-2, 204-3, 204-N can restore a number of distorted properties of the partially dried inkjet media. In some examples, the number of fusers 204-1, 204-2, 204-3, 204-N can apply pressure, tension, and/or heat to the partially dried inkjet media to prepare the partially dried inkjet media for the finisher 210. As described herein, the finisher 210 can perform a number of finishing processes that can be performed when the distorted properties are restored or partially restored, but may not be able to be performed when the distorted properties are present after the printer 202 has generated the partially dried inkjet media. Alternately, the finisher 210 may be less complex in order to perform the desired finishing properties.

Figure 3:
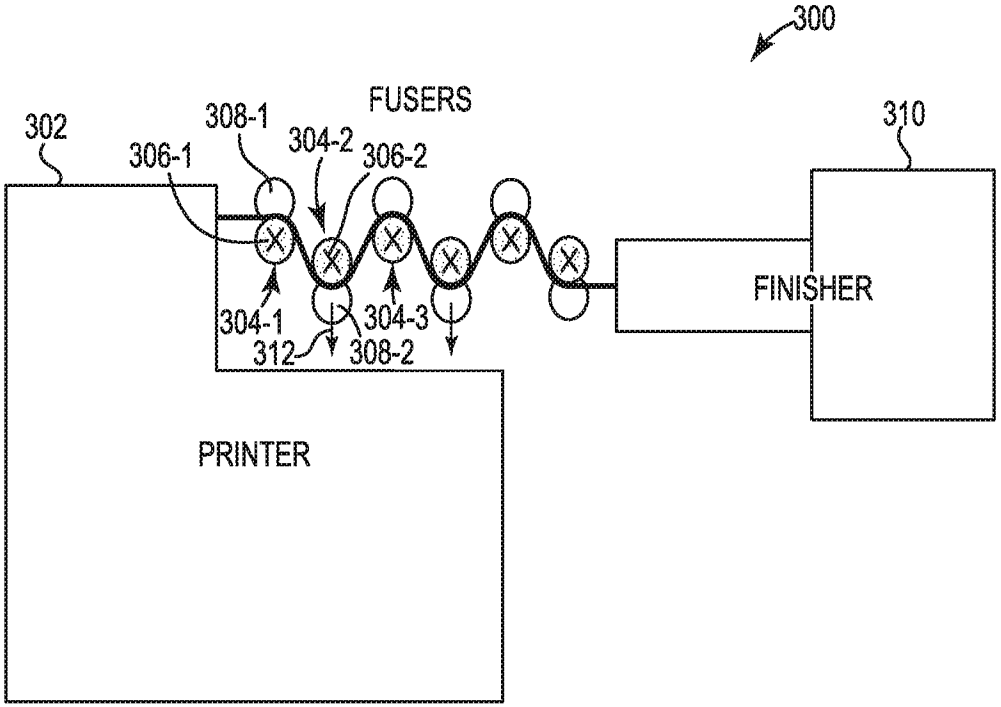
FIG. 3 illustrates an example system for partially dried inkjet media fusers consistent with the present disclosure.

FIG. 3 illustrates an example system 300 for partially dried inkjet media fusers consistent with the present disclosure. The system 300 can include the same or similar elements as system 100 as referenced in FIG. 1 and/or the same or similar elements as system 200 as referenced in FIG. 2. For example, the system 300 can include a printer 302 and a finisher 310 that are coupled to a number of fusers 304-1, 304-2, 304-3, 304-N. In some examples, each of the number of fusers 304-1, 304-2, 304-3, 304-N can include a number of heated rollers 306-1, 306-2 and a number of non-heated rollers 308-1, 308-2.

In some examples, the number of fusers 304-1, 304-2, 304-3, 304-N can be aligned such that a particular wrap angle of the partially dried inkjet media passing through the number of fusers 304-1, 304-2, 304-3, 304-N is applied. For example, the wrap angle of the partially dried inkjet media can be between 0 degrees and 180 degrees. As described herein, the wrap angle of the partially dried inkjet media can provide a particular tension force and/or a particular quantity of tension time for the partially dried inkjet media.

In some examples, the number of fusers 304-1, 304-2, 304-3, 304-N can include a number of alternating fusers (e.g., fuser 304-2, etc.). In some examples, the number of alternating fusers can be fusers that can change position to generate additional tension to the tension generated by the wrap angle. In some examples, the alternating fusers can be altered when the partially dried inkjet media is passing through the alternating fusers. For example, the fuser 304-2 can be altered to a position in the direction of arrow 312 that is relatively lower than an original position of the fuser 304-2 when the partially dried inkjet media is passing through the fuser 304-2.

In some examples, the alternating fusers can change position when the partially dried inkjet media is passing through a particular combination of fusers from the number of fusers 304-1, 304-2, 304-3, 304-N. For example, the fuser 304-2 can be an alternating fuser. In this example, the fuser 304-2 can be altered to a position in the direction of arrow 312 when the partially dried inkjet media is passing through fuser 304-1, fuser 304-2, and fuser 304-3. In this example, a greater tension can be applied to the partially dried inkjet media. For example, the partially dried inkjet media can be positioned such that fuser 304-1 and fuser 304-3 can hold the partially dried inkjet media as the fuser 304-2 can change to a position in the direction of arrow 312.

In some examples, each of the number of fusers 304-1, 304-2, 304-3, 304-N that are positioned between two stationary fusers can be an alternating fuser. As used herein, stationary fusers can be fusers that are not capable of being altered when the partially dried inkjet media is passing through. For example, fuser 304-1 and fuser 304-3 can be stationary fusers while fuser 304-2 can be an alternating fuser. In some examples, each of the number of fusers 304-1, 304-2, 304-3, 304-N can be alternating fusers. For example, fuser 304-1 can change to a first position (e.g., opposite to the direction of arrow 312, etc.), fuser 304-2 can change to a second position (e.g., towards the direction of arrow 312, etc.), and fuser 304-3 can change to the first position. In these examples, a relatively greater tension can be applied to the partially dried inkjet media by applying opposing tension forces to the partially dried inkjet media. This change in position can be accomplished by applying force in the direction of arrow 312 rather than forcing the fuser 304-2 to a predetermined position.

In some examples, a fuser that is nearest to the printer 302 can be a stationary fuser. In some examples, a fuser that is nearest to the finisher 310 can be a stationary fuser. In some examples, tension can be applied to a fuser while the media is held by adjacent fusers. For example, fuser 308-2 can add tension in the direction of arrow 312 as long as the partially dried inkjet media is held by fuser 304-1 and fuser 304-3.

In some examples, there can be an additional number or a fewer number of fusers. In some examples, a fewer number of fusers can be utilized by providing the partially dried inkjet media through the number of fusers 304-1, 304-2, 304-3, 304-N a plurality of times prior to providing the partially dried inkjet media to the finisher 310. In some examples, the number of fusers 304-1, 304-2, 304-3, 304-N can be utilized to cycle the partially dried inkjet media through the number of fusers 304-1, 304-2, 304-3, 304-N multiple times prior to providing the partially dried inkjet media to the finisher 310.

The system 300 can be utilized to apply heat, pressure, and/or tension to the partially dried inkjet media as the partially dried inkjet media passes through the number of fusers 304-1, 304-2, 304-3, 304-N. As described herein, the applied heat, pressure, and/or tension can be utilized to restore a number of distorted properties of the partially dried inkjet media. As described herein, the system 300 can be utilized to prepare the partially dried inkjet media generated by the printer 302 for a finishing process performed by the finisher 310.

As used herein, "logic" is a processing resource to perform a particular action and/or function, etc., described herein, which includes hardware, e.g., various forms of transistor logic, application specific integrated circuits (ASICs), etc., as opposed to computer executable instructions, e.g., software firmware, etc., stored in memory and executable by a processor. Further, as used herein, "a" or "a number of" something can refer to one thing or a plurality of things. For example, "a number of widgets" can refer to one widget or a plurality of widgets.

The above specification, examples and data provide a description of the method and applications, and use of the system and method of the present disclosure. Since many examples can be made without departing from the spirit and scope of the system and method of the present disclosure, this specification merely sets forth some of the many possible example configurations and implementations.

What is claimed:

1. A device, comprising:

a plurality of fusers aligned to receive partially dried inkjet media from a printing device, wherein the plurality of fusers each comprise a top roller and a bottom roller to apply pressure to the received partially dried inkjet media; and a finisher to receive the partially dried inkjet media from the plurality of fusers.

2. The device of claim 1, wherein a number of the top rollers of the plurality of fusers comprise a heated roller.

3. The device of claim 1, wherein a number of the bottom rollers of the plurality of fusers comprise a heated roller.

4. The device of claim 1, wherein a first fuser of the plurality of fusers comprises a bottom roller that is a heated roller and a top roller that is a non-heated roller.

5. The device of claim 4, wherein a second fuser of the plurality of fusers comprises a bottom roller that is a non-heated roller and a top roller that is a heated roller.

6. The device of claim 1, wherein the plurality of fusers apply a wrap angle to the partially dried inkjet media when the partially dried inkjet media passes from a first fuser to a second fuser.

7. The device of claim 1, wherein a position of at least one of the plurality of fusers is altered when the partially dried inkjet media is passing over the at least one of the plurality of fusers.

8. A system for partially dried inkjet media fusers, comprising:

a conditioner comprising a plurality of fusers to apply a pressure to partially dried inkjet media passing through the conditioner;

a printing device coupled to a first end of the conditioner to provide partially dried inkjet media to the conditioner; and a finishing device coupled to a second end of the conditioner to receive partially dried inkjet media from the conditioner.

9. The system of claim 8, wherein the plurality of fusers apply a wrap angle to the partially dried inkjet media when the partially dried inkjet media passes from a first fuser to a second fuser.

10. The system of claim 8, wherein a position of at least one of the plurality of fusers is altered when the partially dried inkjet media is passing over the at least one of the plurality of fusers.

11. The system of claim 10, wherein the at least one of the plurality of fusers is located between at least two stationary fusers.

12. The system of claim 8, comprising an air circulation device coupled to the conditioner.

13. The system of claim 12, wherein the air circulation device circulates air within the conditioner and removes moisture from within the conditioner.

14. A system for partially dried inkjet media fusers, comprising:

a conditioner comprising:

a first fuser comprising a heated bottom roller and a non-heated top roller to receive partially dried inkjet media from a printing device;

a second fuser comprising a non-heated bottom roller and a heated top roller to receive partially dried inkjet media from the first fuser;

a third fuser comprising a heated bottom roller and a non-heated top roller to receive partially dried inkjet media from the second fuser.

15. The system of claim 14, wherein the first fuser and the third fuser are substantially aligned at a first level and the second fuser is positioned at a second level that is different than the first.

16. The system of claim 15, wherein the second fuser applies additional tension to the partially dried inkjet media compared to the first fuser and the third fuser.

17. The system of claim 15, wherein the partially dried inkjet media wraps around a corresponding heated roller as the partially dried inkjet media passes through the conditioner.

* * * * *